United States Patent [19]

Williams, Sr. et al.

[11] 4,084,391

[45] * Apr. 18, 1978

[54] AUTOMATIC PACKAGING APPARATUS

[75] Inventors: Winfried Wilbur Williams, Sr., Salisbury; David Clancy, Canaan, both of Conn.

[73] Assignee: Colgate-Palmolive Company, New York, N.Y.

[ * ] Notice: The portion of the term of this patent subsequent to Aug. 10, 1993, has been disclaimed.

[21] Appl. No.: 691,870

[22] Filed: Jun. 1, 1976

Related U.S. Application Data

[63] Continuation-in-part of Ser. No. 557,093, Mar. 10, 1975, Pat. No. 3,973,373.

[51] Int. Cl.[2] ..... B65B 63/04

[52] U.S. Cl. ..... 53/120; 270/84

[58] Field of Search ..... 53/21 FW, 116, 117, 53/120; 270/67, 80, 83, 84

[56] References Cited

U.S. PATENT DOCUMENTS

| | | | |
|---|---|---|---|
| 722,879 | 3/1903 | Owens | 53/117 X |
| 1,071,853 | 9/1913 | Young | 53/120 |
| 3,481,099 | 12/1969 | Clancy | 53/120 X |
| 3,518,810 | 7/1970 | Steeves | 53/117 |
| 3,873,082 | 3/1975 | Imaizjmi et al. | 270/68 A |
| 3,973,373 | 8/1976 | Williams et al. | 53/120 |

*Primary Examiner*—Travis S. McGehee

*Attorney, Agent, or Firm*—Strauch, Nolan, Neale, Nies & Kurz

[57] ABSTRACT

Method and apparatus for automatically packaging towelettes in envelopes positioned in succession at an insertion station wherein the longitudinally folded leading end of a web of absorbent towelette material is severed to provide successive strips of predetermined length, and each strip is folded transversely first to a J-fold condition wherein the longer leg of the J is about twice the length of the shorter leg, and the longer leg of the J of each strip is folded substantially about its midpoint to form a folded towelette of three times the original longitudinally folded strip thickness as it is being thrust into an envelope positioned in timed relation at the insertion station. The J-folded strip is transferred between the transverse folds by a conveyor comprising one or more pairs of driven rolls each pair defining a pass between them substantially equal to the thickness of a severed strip, and the rolls of each pair being relatively resiliently mounted to permit increased relative separation temporarily as for permitting passage of increased strip thickness. Where the web is of non-woven fabric the longitudinal fold is ironed under heat and pressure to enhance the fold prior to severing.

8 Claims, 14 Drawing Figures

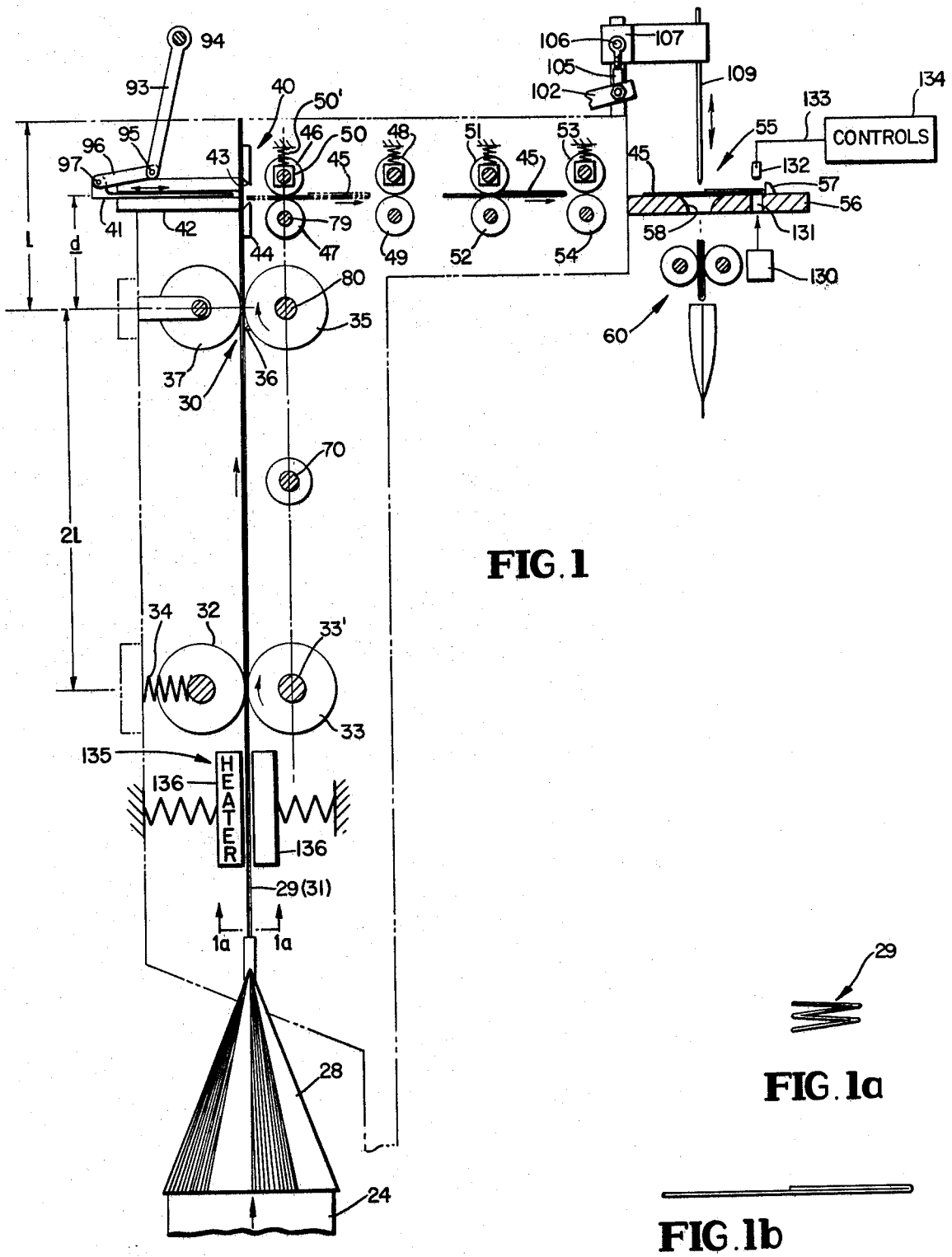
FIG. 1
FIG. 1a
FIG. 1b
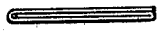
FIG. 1c

AUTOMATIC PACKAGING APPARATUS

This is a continuation-in-part of Ser. No. 557,093 filed Mar. 10, 1975 for Automatic Packaging Method and Apparatus now matured into U.S. Let. Pat. No. 3,973,373 issued Aug. 10, 1976.

This invention relates to methods and automatic apparatus for the packaging of folded towelettes or like sheets and particularly to correlated compact and efficient combinations of method steps and apparatus for continually forming, at the leading end of a continuous web of sheet material, longitudinally and transversely folded individual sheets in condition for packaging.

More specifically in its preferred embodiment the invention is concerned with the automatic sealed packaging of folded moist towelettes, usually rectangular sheets in the order of about five by eight inches when unfolded, and particularly in that phase wherein a flat web of dry absorbent sheet material is continuously drawn from a supply such as a large diameter roll with the leading end subjected to correlated folding and severing operations to continually produce individual folded towelettes and thrust them into individual packages that are then conventionally supplied with liquid for moistening the towelettes and sealed.

The invention provides as a major advantage novel methods and apparatus wherein the towelette material is subjected to an efficient sequence of successive linear angularly related movements terminating in individual folded towelettes being thrust into separate envelopes.

Another advantageous feature of invention is the provision of a novel method and apparatus whereby the leading end of a longitudinally folded web is moved through a web severing station into a first transverse fold station with a predetermined length being severed therefrom in timed relation with mechanism substantially directly and immediately imparting the first transverse fold of the severed length, whereby the severed length or strip assumes a J-fold condition, and then conveying the J-folded strip to a station where a second transverse fold is imparted to achieve a triple strip thickness condition while thrusting the folded towelette into an open envelope automatically positioned to receive it at the station.

A further advantageous feature of the invention is the provision of a novel compact mechanism in a machine for packaging folded towelettes whereby synchronously operated first and second transverse folded blades and a novel conveyor between them coact to impart sequential substantially linear fold and transfer movements to the towelette during folding.

A further advantageous feature of invention is the provision of heating means for consolidating the longitudinal fold in the web, particularly useful where the web is non-woven fabric.

Further advantages will appear as the description proceeds as connection with the appended claims and the annexed drawings.

BACKGROUND OF INVENTION

Within applicant's knowledge the particular art to which the invention primarily pertains commercially originated essentially with machines and methods of the type disclosed in the patents to Clancy U.S. Pat. No. 3,481,099 and Weinberger U.S. Pat. No. 3,286,435, and improved in the above-identified application. Each discloses machines for automatically packaging folded moist towelettes wherein the leading end of a web of absorbent towelette material is longitudinally folded, and then severed into towelette lengths which are transversely folded and thrust into envelopes automatically positioned in succession at a filling station. Clancy discloses imparting two transverse folds to the severed longitudinally folded towelette length prior to insertion into the envelope.

The present invention is directed to related methods and apparatus of the Clancy patent type, and particularly to arrangements for handling the web and towelette and especially to methods and mechanism for dual transverse folding of the severed longitudinally folded towelette, except that in the invention the dual transverse fold produces a thinner less bulky folded towelette in the envelope resulting in a thinner overall final package.

BRIEF DESCRIPTION OF DRAWINGS

FIG. 1 is a side elevation, somewhat schematic and partly sectioned, illustrating the invention according to a preferred embodiment;

FIG. 1*a* is a view substantially on line 1*a*—1*a* of FIG. 1 diagrammatically showing the nature of the longitudinally folded strip section;

FIG. 1*b* diagrammatically shows the J-fold condition of the severed strip formed at the first transverse fold station;

FIG. 1*c* diagrammatically shows the triple thickness final fold of the strip after it has been thrust into the envelope;

PREFERRED EMBODIMENTS

Figure 2:
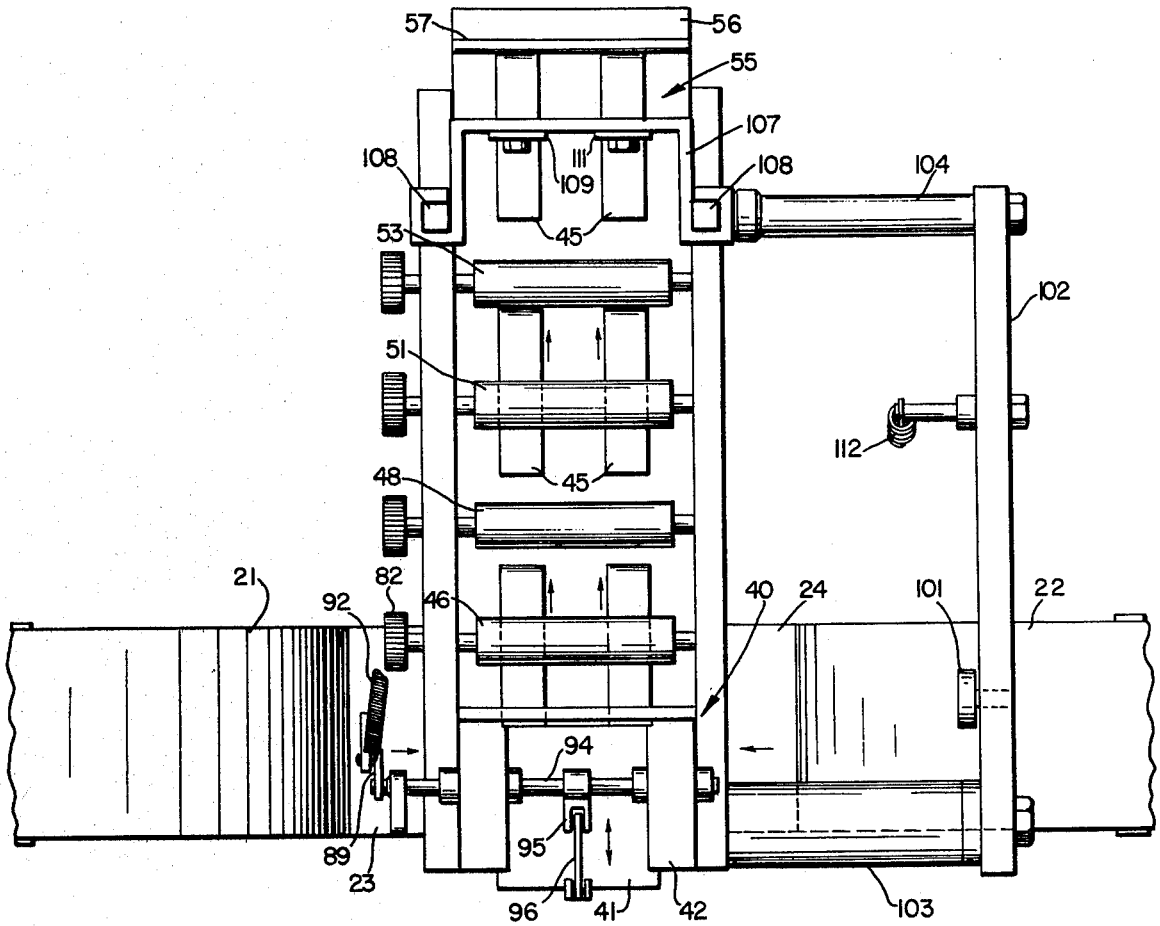
FIG. 2 is a fragmentary top plan view showing part of the apparatus of FIG. 1.
Figure 3:
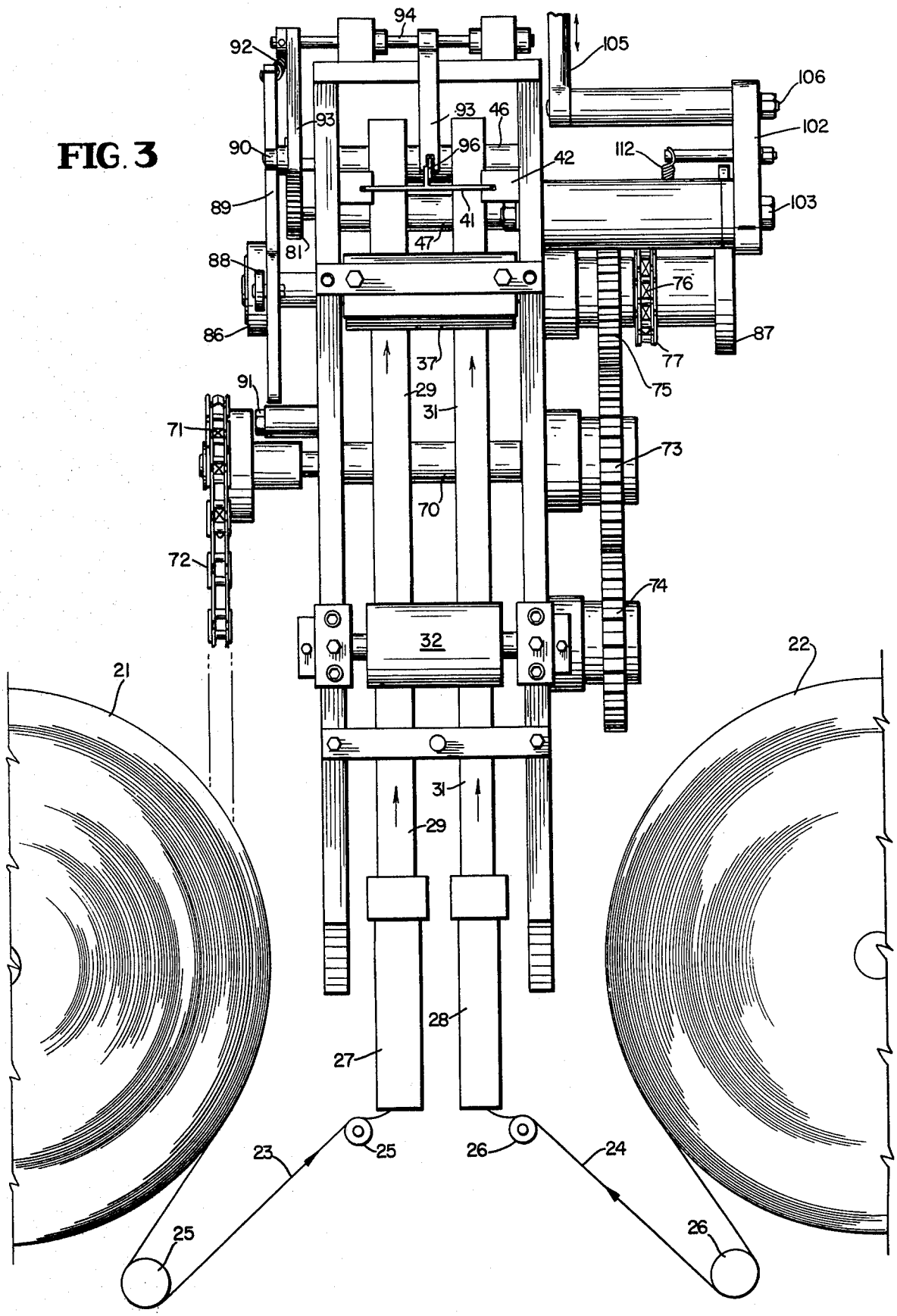
FIG. 3 is a front elevation further showing the apparatus of FIG. 1.

Referring to FIGS. 1–3, the illustrated apparatus is arranged to thrust folded towelettes into two side-by-side envelopes at the filling station, two towelette webs being fed into the machine and handled similarly side-by-side as will appear.

It will be understood that the invention is not limited to this particular embodiment, but is applicable to appratus wherein any number of folded towelettes are simultaneously thrust into the corresponding number of envelopes. For example the invention may also be incorporated into single towelette apparatus such as disclosed in Clancy or Weinberger, or to apparatus wherein three or even more towelettes may be thrust at the same time into the corresponding number of side-by-side envelopes.

As shown in FIG. 3, two large diameter rotatable supply rollers 21 and 22 of absorbent paper or absorbent non-woven fabric provide webs 23 and 24 that pass over guides 25 and 26 respectively into separate longitudinal fold formers 27 and 28. The webs for packaging moist towelettes may be for example each about 5 to 5½ inches wide, and they pass into the formers substantially just above floor level. In the formers the webs are longitudinally folded and they emerge from the upper ends of the formers as relatively narrow folded flat tapes indicated at 29 and 31, which are parallel to each other and move side-by-side vertically upwardly in a substantially common plane perpendicular to the axes of rolls 21 and 22 in FIG. 3.

The longitudinal fold formers 27 and 28 may be conventional and they may be the formers disclosed in said Weinberger et al. U.S. Pat. No. 3,286,435 or in Benitez U.S. Pat. No. 3,361,425 to both of which reference is made for any further details necessary to understand the longitudinal folding operation.

FIG. 1 shows the apparatus as viewed looking from right to left in FIG. 3. The tapes 29 and 31 pass side-by-side between continuously rotating parallel feed rollers 32 and 33, with roller 33 being suitably driven as will appear and roller 32 biased as by spring 34 toward the driven roller to define a positive feed roll pass capable of accommodating to slight variations in tape thickness. At this point the web is longitudinally folded with an accordian type fold as shown in FIG. 1*a*. The surface of driven roller 33 is preferably knurled for more positive feed.

Above the feed roll pass, the tapes move side-by-side through a web severing station 30 having a rotary knife device comprising a continuously rotated roller 35 mounting a longitudinal knife blade 36 and an idly rotatable fixed axis roller anvil 37.

Above the rotary knife device, the tapes pass side-by-side directly into the first transverse fold station indicated at 40 in FIG. 1. At station 40 the leading ends of the tapes extend vertically in the path of a horizontally reciprocable first fold blade 41 that slides in a fixed guide 42 at right angles to the path of travel of the tapes to engage and impart the first transverse fold in the severed web stripes.

In operation as will appear, the rotary knife device severs a towelette length strip from the leading end of each tape and substantially immediately the blade 41 is moved to the right in FIG. 1 to engage each severed towelette strip to start folding and psuh each towelette strip during folding in side-by-side relation through a slotted horizontal aperture 43 in a fixed vertical guide 44, whereby each severed towelette strip is similarly transversely folded with a J-fold as will later be described in detail and in that condition, as shown in FIG. 1 at 45, is pushed into a first transit roll pass consisting of upper and lower horizontal axis rollers 46 and 47.

Roll pass 46, 47 is the first of a series including transit roll passes 48, 49, 51, 52 and 53, 54 which convey the first transversely folded towelettes 45 side-by-side horizontally to the second transverse fold station indicated at 55. The foregoing transit roll passes define a horizontal path for each first folded towelette, and all of these transit rolls are preferably surface knurled and positively driven for assuring proper timed arrival of the J-folded towelettes at the second transverse fold station 55.

Figure 7:
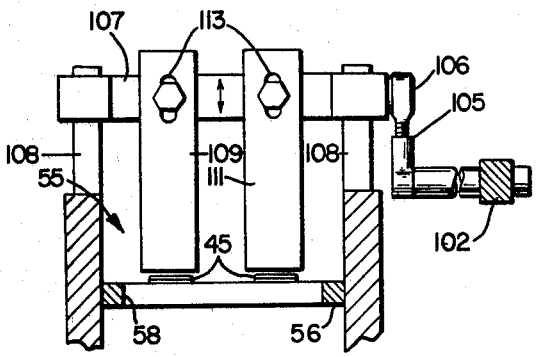
FIG. 7 is a fragmentary end view partly sectioned showing the vertically reciprocable second fold blades.

At the second transverse fold station, the two first transversely folded towelettes 45 which have been delivered side-by-side by the transport rollers onto the horizontal top surfaces of a fixed plate 56 and arrested by stop 57 in longitudinally centered side-by-side position over plate opening 58 are individually simultaneously medially engaged by vertically descending blades 109 and 111 (FIG. 7) and thrust through aperture 58 whereby they are imparted a second transverse fold and downwardly inserted in final folded three thickness of strip condition in side-by-side envelopes, substantially as indicated at 60 in FIG. 1.

The circumference of knife mounting roll 35 is preferably equal to the unit length *l* of the tape strip section to be severed. In a practical embodiment where each folded tape 29, 31 may be about 1 to 1⅜ inches wide, the unit length of the strip to be severed for towelette purpose is about 7½ to 8 inches, and during each revolution of continuously rotating knife roller 35 one such length strip *l* is severed from each tape.

By providing a fixed axis freely rotating roller anvil at 37, the severing action is cleaner and there is less wear on the knife blade 36.

Preferably the feed rollers 32 and 33 are of the same diameter and rotate at the same surface speed as knife roller 35 so that there is no slack between the feed and cutting stations. While the knife roller 35 preferably rotates only once to produce a single towelette, the rollers of the feed roller pass may turn any multiple of once per towelette strip unit length to produce the necessary tape speed. Thus in a preferred embodiment the rollers 35 and 33 may have circumferences each equal to *l*, and the distance between the axes of rollers 33 and 35 may be 2*l*.

The distance *d* between a horizontal plane containing the axes of rollers 35, 37 of the rotary knife station and the line of cut effected by the knife blade, and the plane of reciprocation of first fold blade 41, is equal to two-thirds the unit towelette strip length *l*, and the operation of the parts is so timed that knife blade 36 severs the tapes each time there is a towelette unit length *l* projecting above the horizontal plane through the knife roller axis, and substantially at the same time blade 41 is moved to the right to engage the severed towelette strip and fold and thrust it into the takeaway transit roll pass 46, 47.

Since as indicated in FIG. 1 one-third of the severed towelette length *l* extends above the plane of reciprocation of blade 41 at the time of the first transverse fold, a substantially J-fold condition results as shown in FIG. 1*b*, and in that condition the towelette having the first transverse fold is conveyed to the second fold station 55 where it is medially engaged by descending blade 109 which imparts the second transverse fold to attain the triple strip thickness condition shown in FIG. 1*c* and at the same time thrusts the towelette into the envelope.

Figure 9:
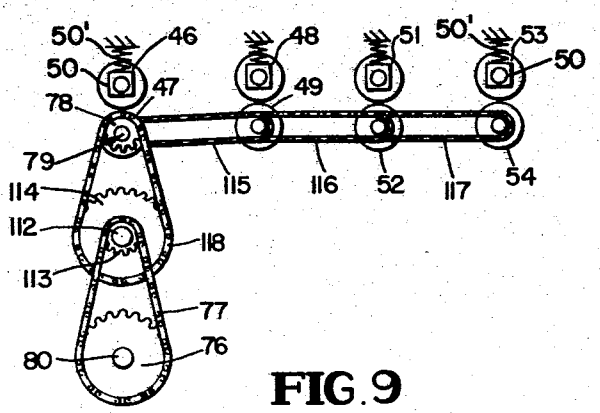
FIG. 9 is a fragmentary side elevation showing the drive to the transit rollers.

The J-folded towelette may present different thicknesses to the pairs of transit rolls along its length and to accommodate this each non-driven upper roll is preferably mounted with its periphery spaced from the driven roll below slightly less than the thickness of the longer leg of the J-folded strip for positive feeding and with its ends carried in bearing mounts that may displace upwardly against a light spring bias as shown in FIG. 1. As shown in FIGS. 1 and 9, the end shafts of upper transit rollers 46, 48, 51, 53 are mounted in bearing blocks 50 that are biased by springs 50' to their lower limit position. The springs permit vertical separation of the rolls of each pair while retaining good drive contact. The actual relative movement between the rollers of each pair is of course very small so that it does not interrupt the drive. This ensures positive uniform feed and eliminates wrinkling even though for example as illustrated in FIG. 1 one pair of rolls 51, 52 may be engaging the single thickness leg of the J-fold strip while the next pair of rolls 53, 54 may be engaging the dual thickness at the shorter leg.

Also whereas in earlier machines such as those of the above-identified application the rollers of first transit roll pass 46, 47 were vertically spaced apart slightly more than the others, for the purposes of allowing full stroke of blade 41 and avoiding binding of the blade 41 and damaging of the operating mechanism when the blade 41 first delivers the towelette strips into transit roll pass 46, 47 in the foregoing construction while blade 41 is pushing the towelette through the roller pass 46, 47 the resilient mount of upper roll 46 provides for compensative separation of the rolls and eliminates binding. Thus all of the transit roller pairs may be similarly mounted.

It has been found a practical operation that the upwardly extending longitudinally folded leading ends of the tapes above the rotary knife are substantially self-supporting, and that no upper end stop is needed although one may be provided if needed to arrest upward movement of the tape ends. Also by efficient correlated timing of blade 41 no special side support or guide 44 for the severed towelette strip is required and the blade 41 thrusts the towelette strip directly into the nip of rollers 46, 47.

The surface speeds of the horizontal series of rollers 46–54 must be large enough to help ensure that each first transversely folded towelette 45 is clear of the first fold station out of the path of the continuously upcoming ends of the tapes. Usually this is attained by rotating the rollers 46–54 at surface speeds a predetermined amount higher than that of knife roller 35, as for example about 10–20%.

While four sets of transit rollers are shown between the first and second transverse fold stations, fewer sets may be needed for shorter distances between the stations, and in one embodiment the takeaway pass rollers 46, 47 may deliver the folded towelette 45 directly to the second fold station 55. An advantage of having several sets of transport rollers is that they increasingly tighten the fold of the strip to provide towelette 45 in substantially optimum flat form at the second fold station.

Referring again to FIG. 1, it will be noted that all of the web, tape and towelette handling rolls are rotatable on parallel horizontal axes. A drive shaft 70 suitably journalled on the machine frame has at one end (FIG. 3) a sprocket 71 drive connected to a chain 72 driven from a motor or like source of power (not shown). At its opposite end shaft 70 carries a gear 73 meshed with gear 74 on the shaft 33' of feed roller 33 and gear 75 on the shaft 80 of knife 35. Thus, where rollers 33 and 35 of the same diameter and gears 74 and 75 of the same size, equal surface speeds in the same direction are provided for rollers 33 and 35.

Figure 11:
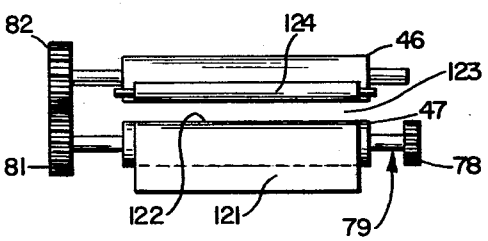
FIG. 11 is a front elevation showing fixed guide structure of FIG. 10 and the roller drive arrangements.

Shaft 80 of knife roller 35 is connected by a suitable drive system to continuously rotate the shaft 79 of lower takeaway transit roller 47. This drive system may be a direct gear train or it may be the sprocket and chain drive system shown in FIG. 9 and later described in more detail. At the opposite side of the transport, rollers 46 and 47 are drive connected by meshed gears 81 and 82 (FIG. 11). The lengths of the gear teeth as at 81, 82 are such as to retain operative mesh even when the resiliently biased rolls are slightly separated by the blade 41 and/or the towelette thickness of the shorter leg of the J-fold. Suitable chains and/or gears connect rollers 46–54 to be all positively driven at the same surface speeds as will be described in later detail in connection with FIG. 9. In practice, shaft 79 (FIG. 4) comprises an inner section 83 non-rotatably mounting roller 47 and an outer section 85 fixed to sprocket 78, so that should blade 41 become entrapped between rolls 46 and 47 a shear limiting device 84 between the shaft sections will break the drive and stop the transport mechanism.

Figure 4:
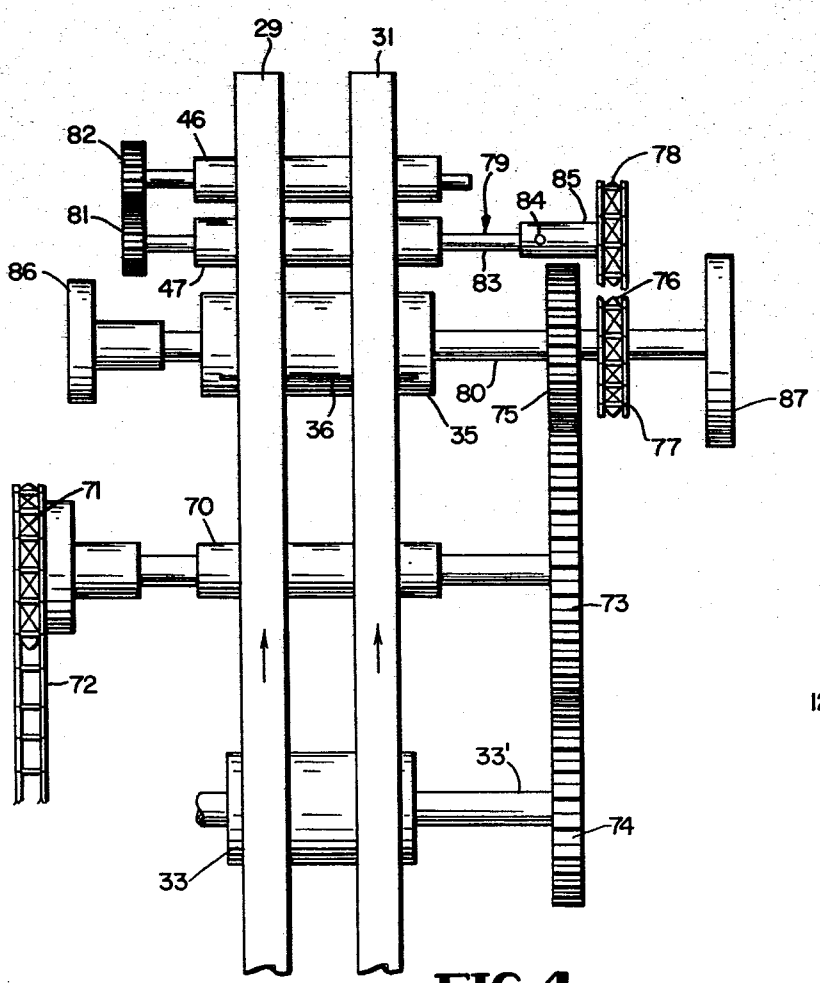
FIG. 4 is a fragmentary front elevation showing details of the drive arrangements.

As shown in FIG. 4, cams 86 and 87 are mounted on the opposite ends of the knife rotor shaft 80, and as shown in FIG. 1 the axes of feed roller 33, drive shaft 70, rotor shaft 80 and transit rollers 46 and 47 lie in a common vertical plane parallel to the direction of movement of the longitudinally folded webs.

Figure 5:
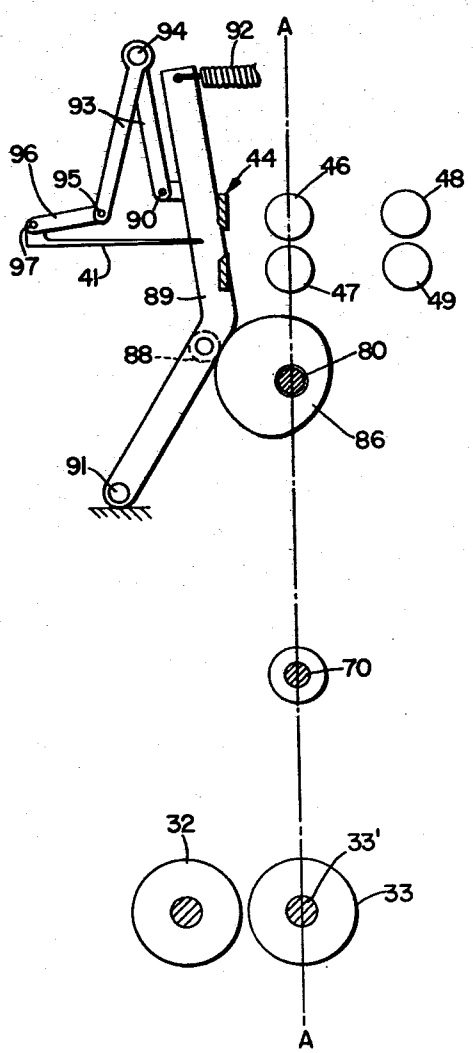
FIG. 5 is a fragmentary side elevation showing the relationship of the parts and some details of the transverse folding mechanism.

As shown in FIG. 5, cam 86 engages a cam follower roller 88 on a lever 89 rockable about a fixed axis pivot 91 on the machine frame. A bell crank 93 pivotally connected at 90 to lever 89 is pivotally mounted on the frame at 94 and pivotally connected at 95 to one end of a link 96 pivoted at its other end at 97 to the rear end of blade 41, whereby reciprocable blade 41 is cyclically moved in one direction by cam 86 and in the other direction by spring 92. Since spring 92 moves the blade into contact with the severed towelette there is less possibility of injury to the towelette.

Figure 6:
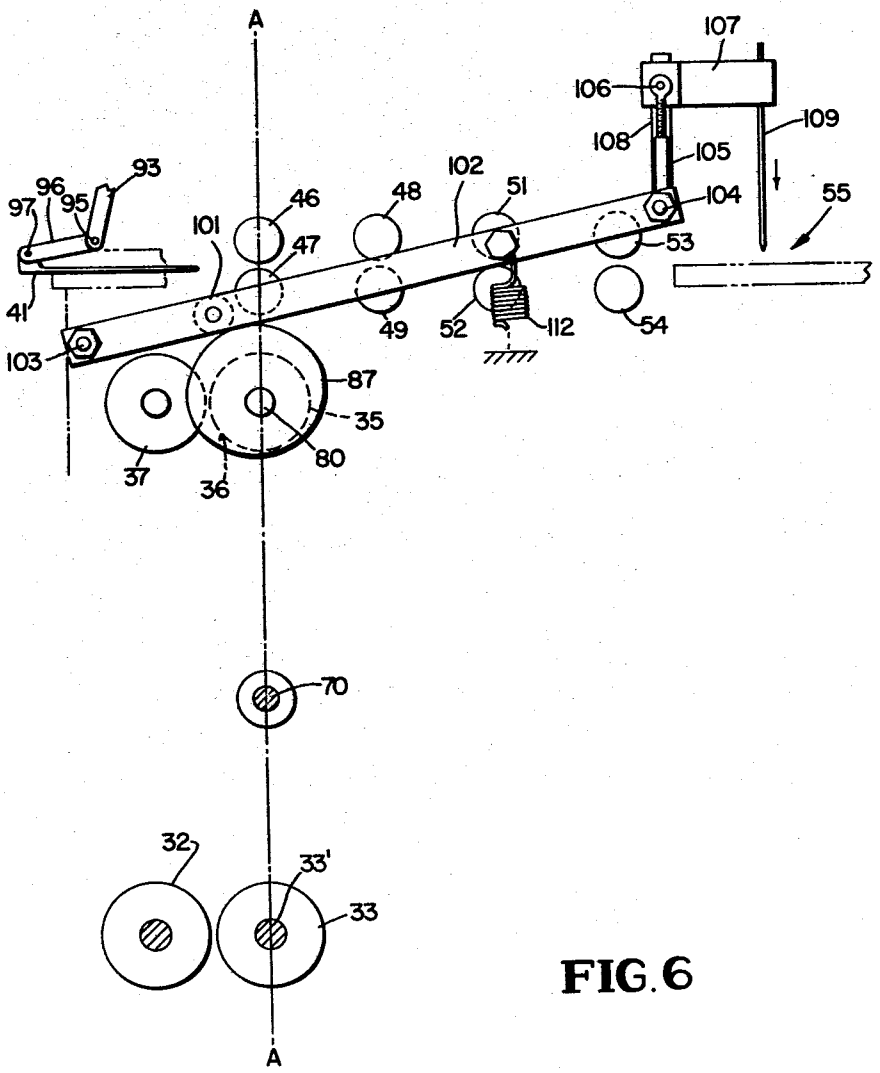
FIG. 6 is a fragmentary side elevation similar to FIG. 5 but showing further details of the transverse folding mechanism.

Referring now to FIG. 6, cam 87 on shaft 80 engages a follower roller 101 on a lever 102 pivoted at one end on the frame at 103 and at its other end at 104 to an adjustable length link 105 pivoted at one end of 106 to a cross head 107 vertically slidably mounted in guides 108 and mounting laterally spaced vertically reciprocable second fold blades 109 and 111. A spring 112 biases lever 102 clockwise in the folding direction. Each blade 109 and 111 is connected to the cross head by a slot and screw connection 113 (FIG. 7) permitting separate vertical adjustment of each for optimum action in second folding and thrusting towelettes.

Figure 8:
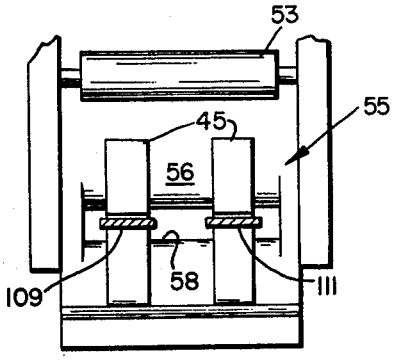
FIG. 8 is a fragmentary top plan view showing the apertured plate at the second fold station.

In operation, as the blades 109 and 111 reciprocate vertically under the influence of cam 87 and spring 112 they medially engage the respective J-folded towelettes 45 (FIG. 8) to thrust them while folding through slot 58 into the envelopes positioned below.

The particular arrangements for automatically positioning envelopes below slot 58 in time with each reciprocation of blades 109 and 111 does not comprise part of the present invention and preferably it may comprise the arrangement disclosed in Clancy U.S. Pat. No. 3,481,099 to which reference is made for further disclosure needed to understand this feature.

As shown in FIG. 9 one form of drive transfer to the series of rollers in the transit conveyor system between the first and second transverse fold stations comprises an idler shaft 112 journalled in the frame and mounting a sprocket 113 connected by chain 77 to sprocket 76 on the knife rotor shaft.

In the embodiment shown in FIG. 9, a further larger diameter sprocket 114 on shaft 112 is connected by chain 118 to sprocket 78 on the shaft 79 of lower transit roll 47. Chain and sprocket connections indicated at 115, 116 and 117 connect the lower rollers of each pair of rollers in the transport system to be positively driven, and at the opposite side each pair of rollers 48, 49; 51, 52 and 53, 54 is greared together in the manner shown for the roller pairs 46, 47 in FIG. 11. All of the sprockets in the lower rollers of each apir are of the same size, and the interconnecting gears for each pair are of the same size so that all of the transit rollers are continuously driven at the same surface speed and at a higher surface speed than feed roller 33 and knife roller 35. The ratio of speed between feed rollers 32, 33 and the transit rollers is determined by the relative diameters of sprockets 113 and 114, and these sprockets may be replaceable by different ratio pairs according to requirements.

Figure 10:
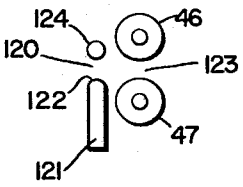
FIG. 10 is a fragmentary side view showing entry of the first folded towelette material into the transit section.

FIGS. 10 and 11 also illustrate a practical guide structure in the first transverse fold station. Viewed from the same side as in FIG. 1, the folding aperture indicated at 120 in FIG. 10 is defined along the bottom by a fixed plate 121 extending parallel to take away transit roller 47 but terminating in a rounded upper end 122 parallel to and just below the gap 123 between rollers 46 and 47. The top side of the aperture 120 is defined by a circular cross section rod 124 fixed on the frame to extend parallel to the rounded end of plate 121. The width of aperture 120 is constant and parallel to and coextensive with the space 123 between rollers 46 and 47.

FIG. 1 also illustrates a monitoring system whereby a beam of light from a source 130 passes through a bore 131 in plate 56 to a photoelectric cell unit 132 connected as at 133 at a control assembly 134 in the circuit of an electric motor driving shaft 70. Control assembly 134 may be of any configuration, but preferably it contains a relay energized to open the drive motor circuit within a fixed time whenever the photocell signals that a towelette 45 has arrived at stop 57 and has cut off the light beam. The timing of the relay is such however that if the fold blades 109, 111 descend in proper sequence to displace and thrust the towelette through slot 58, reestablishment of impingement of the light beam on the photocell will immediately deenergize the relay and there will be no interruption to the motor circuit.

It has been proposed that the towelettes be formed from webs of non-woven material such as fabrics made of bonded absorbent warp threads only or having sinuous or spaced weft threads. Due to memory characteristics of this material it may tend to reexpand slightly after folding and this problem arises particularly where the web has been longitudinally folded and is being severed and first folded. The problem is substantially eliminated by applying heat and pressure to the web substantially directly after the longitudinal folding operation.

With reference to FIG. 1 the heat may be applied while the folded tape is under pressure in the feed roll pass at 32, 33 one or both of rolls 32 and 33 being surface heated as by internal electrical resistance elements suitably connected to current supply through their end mounts.

Optionally the heat may be applied by radiant heaters at the feed roll pass, or both heat and pressure may be applied as the folded tape approaches the feed roll pass as by the unit indicated at 135 wherein suitably heated shoes 136 are lightly spring biased to contact with opposite sides of the tape. The spring bias should be enough to retain the imparted fold while heating, without interferring with longitudinal feed of the tape. The effect is substantially that of ironing a permanent press condition which will be retained at least until the severed strip is packaged.

This eliminates any problem of entry of the free leading end of the tape into the first fold station due to thickness expansion. Once the J-fold has been accomplished, and the towelette is in the transit rolls the spring biased rolls tend to increase the fold.

The invention thus provides a compact and highly efficient automatic packaging machine wherein a continuously moving flat web is longitudinally folded at the leading end which is quickly severed into individual towelette strips that are positively double folded and thrust into envelopes with minimum waste motion. In the preferred apparatus, the web is moved between the longitudinal fold former and the envelope in a succession of only three straight line movements in perpendicular succession during which the transverse folding takes place. The invention is of course also readily applicable to other apparatus, such as that of the Clancy and Weinberger patents.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all changes which come within the meansing and range of equivalency of the claims are therefore intended to be embraced therein.

What is claimed and desired to be secured by Letters Patent is:

1. Apparatus for automatically packaging towelettes and comprising means for positioning open envelopes in succession at an insertion station, characterized by means for feeding the longitudinally folded leading end of a web of absorbent towellete material in a substantially vertical upward path, means for severing successive strips of predetermined length from said longitudinally folded moving leading end at the end of said path, first transverse fold means for folding each of said strips in succession into a J-fold condition wherein the longer leg of the J is about twice the length of the shorter leg and each first folded strip is moved along a substantially horizontal path, and second transverse fold means for folding the longer leg of the J of each said first folded strip in succession substantially about its midpoint to form a folded towelette of about three times the original longitudinal folded strip thickness while at the same time thrusting it substantially vertically downward into an envelope positioned at said station in timed relation to receive it.

2. In the apparatus defined in claim 1, means for subjecting the longitudinally folded web prior to severing to heat and pressure for enhancing the folded condition.

3. Automatic packaging apparatus of the type wherein a continuously moving web is longitudinally folded and predetermined length strips of the longitudinally folded web are severed in succession from the leading end of said web, transversely folded and thrust into receptacles positioned in timed relation at an insertion station, characterized by longitudinal fold means disposed to receive a moving web from a supply and provide a longitudinally folded leading end on the web, web feed means for receiving the folded leading end of the web and continuously moving it in a path, means in said path for severing said continuously moving leading end into successive longitudinally folded strips of predetermined length, first transverse fold means for transversely folding each said severed strip in turn, conveying means for directly receiving each transversely folded strip and continuously advancing it into an insertion station, and means at said insertion station for imparting a second transverse fold to each strip in turn while thrusting it into a receptacle positioned at said station, said conveying means comprising at least one pair of driven rolls defining a pass between them substantially equal to the thickness of a severed strip, and means resiliently permitting increased relative separation of said rolls as for permitting passage of increased strip thickness.

4. Apparatus for automatically packaging towelettes and comprising means for positioning open envelopes in succession at an insertion station, characterized by means for feeding the longitudinally folded leading end of a web of absorbent towelette material in a path, means for severing successive strips of predetermined length from said longitudinally folded moving leading end, first transverse fold means for folding each of said strips in succession into a J-fold condition wherein the longer leg of the J is about twice the length of the shorter leg, second transverse fold means for folding the longer leg of the J of each strip in succession substantially about its midpoint to form a folded towelette of about three times the original longitudinally folded strip thickness while at the same time thrusting it into an envelope positioned at said station in timed relation to receive it, and conveying means whereby said J-folded strip is conveyed between said first and second transverse fold means comprising at least one pair of driven rolls defining a pass between them substantially equal to the thickness of a severed strip, and means resiliently permitting increased relative separation of said rolls as for permitting passage of increased stip thickness.

5. Apparatus as defined in claim 4 including means in said path adjacent the web feed means for subjecting the moving folded web to heat and pressure to enhance the folded condition.

6. Apparatus as defined in claim 5, wherein said web feed means comprises a positive feed roller pass heated to provide said means for imparting heat and pressure to said longitudinally folded web.

7. Apparatus as defined in claim 5, wherein said means for subjecting the longitudinally folded web to heat and pressure is disposed to act on the web prior to entry into said feed means.

8. Apparatus for automatically packaging towelettes and comprising means for position open envelopes in succession at an insertion station, characterized by means for feeding the longitudinally folded leading end of a web of absorbent towelette material in a path, means for severing successive strips of predetermined length from said longitudinally folded moving leading end, first transverse fold means for folding each of said strips in succession into a J-fold condition wherein the longer leg of the J is about twice the length of the shorter leg, second transverse fold means for folding the longer leg of the J of each strip in succession substantially about its midpoint to form a folded towelette of about three times the original longitudinally folded strip thickness while at the same time thrusting it into an envelope positioned at said station in timed relation to receive it, control means for said web feeding means, and means responsive to the operative presence or absence of a J-folded strip at said second fold means for actuating said control means.

* * * * *